United States Patent [19]

Carl

[11] 4,397,567

[45] Aug. 9, 1983

[54] TIMEPIECE CONSTRUCTION WITH A CASEBACK REMOVABLE USING A CREDIT CARD

[75] Inventor: Stewart Carl, Cupertino, Calif.

[73] Assignee: Timex Corporation, Waterbury, Conn.

[21] Appl. No.: 204,432

[22] Filed: Nov. 6, 1980

[51] Int. Cl.[3] ..... G04B 37/00

[52] U.S. Cl. ..... 368/309; 368/292

[58] Field of Search ..... 368/288, 290, 291, 309, 368/289, 319, 320, 321, 292

[56] References Cited

U.S. PATENT DOCUMENTS

| | | | |
|---|---|---|---|
| 2,830,434 | 4/1958 | Trautz | 368/292 |
| 2,875,574 | 3/1959 | Dinstman | 368/291 |
| 3,264,820 | 8/1966 | Piquerez | 368/292 |
| 3,643,424 | 2/1972 | Simon | 368/291 |
| 3,783,604 | 1/1974 | Florent et al. | 368/291 |
| 3,940,922 | 3/1976 | Miyasaka et al. | 368/292 |

FOREIGN PATENT DOCUMENTS

| | | | |
|---|---|---|---|
| 339874 | 9/1959 | Switzerland | 368/309 |
| 392397 | 9/1965 | Switzerland | 368/291 |
| 1152298 | 5/1969 | United Kingdom | 368/291 |
| 1200717 | 7/1970 | United Kingdom . | |
| 1535005 | 12/1978 | United Kingdom . | |
| 1552587 | 9/1979 | United Kingdom . | |

*Primary Examiner*—Bernard Roskoski

*Attorney, Agent, or Firm*—William C. Crutcher

[57] ABSTRACT

A timepiece construction is disclosed in which a back cover member can be unsnapped from a case by using a credit card as a lever. Typically, the back cover member includes a slanted lip along one side and the timepiece case includes a pair of attachment lugs adjacent the lip, each lug having a first slanted wall spaced from the cover member lip to define slots to receive one end of the credit card and further each lug having a second slanted wall intersecting the first wall to define fulcrums for contacting the credit card intermediate its ends. One end of the credit card is inserted in the slots and force is applied to the other end to pivot the credit card about the fulcrums to lift the lip of the back cover member and thereby unsnap it from the case.

4 Claims, 6 Drawing Figures

TIMEPIECE CONSTRUCTION WITH A CASEBACK REMOVABLE USING A CREDIT CARD

FIELD OF THE INVENTION

The present invention relates to timepiece constructions and, more particularly, to constructions of the type having a back cover member snap-fitted to a case to close off an access opening in the latter.

DESCRIPTION OF THE PRIOR ART

The use of the so-called snap-fitting techniques to assemble timepiece components such as the crystal, bezel and back cover to a timepiece case is common, e.g., see the Gisiger U.S. Pat. No. 2,720,748 issued Oct. 18, 1955, the Dinstman U.S. Pat. No. 3,696,608 issued Oct. 10, 1972; the Grohoski U.S. Pat. No. 4,067,186 issued Jan. 10, 1978 and the Wuthrich U.S. Pat. No. 4,188,778 issued Feb. 19, 1980. Snap-fitting generally involves elastic engagement of two or more of the components by means of cooperation between a circumferential lip, flange or rib on one component and a corresponding groove, shoulder or the like on the other component. A typical and well known example is the engagement of the back cover, also referred to as a caseback, to the timepiece case wherein the back cover includes an outwardly directed circumferential lip and the case includes a circumferential groove or shoulder to engage the lip and thereby hold the components together. Usually, sealing means in the form of an annular gasket is placed between the back cover and case to provide a joint resistant to penetration by moisture. Although the circumferential engagement system just described functions satisfactorily to hold the back cover and case together, it suffers from the disadvantage that removal of the back cover is difficult, typically requiring a screwdriver or like tool, and oftentimes results in damage to the back cover, case or both from contact with the tool. The problem is especially severe when a plastic, rather than metal, back cover and/or case are used.

SUMMARY OF THE INVENTION

An object of the present invention is to provide a timepiece construction of the type having a back cover member snap-fitted to a case in which the back cover member can be readily removed for access to the timepiece battery or other internal components by using a conventional credit card as a lever to unsnap the back cover member from the case without damage to either component.

The invention is especially useful and advantageous when the timepiece case or back cover member or both are made of plastic to prevent damage thereto during separation.

Briefly, the timepiece construction of the present invention involves a case and back cover member which have adjacent portions configured to define a slot therebetween in which one end of a conventional credit card can be inserted for use as a lever to unsnap the caseback. To this end, the timepiece case includes other portions which define a fulcrum to contact the credit card intermediate its ends and about which the credit card pivots when used as a lever to unsnap the back cover member from the timepiece case.

In a preferred embodiment, the back cover member includes a slanted lip along a side adjacent the attachment lugs of the case and the lugs each include a slanted first wall adjacent and spaced from the lip to define slots for receiving one end of the credit card and a differently slanted second wall intersecting the first wall to form fulcrums at their intersection for pivoting of the credit card. The back cover member is removed simply by inserting one end of the credit card into the slots and pressing on the other end to lift the lip of the back cover member and unsnap it from the watch case.

DESCRIPTION OF PREFERRED EMBODIMENTS

Figure 1:
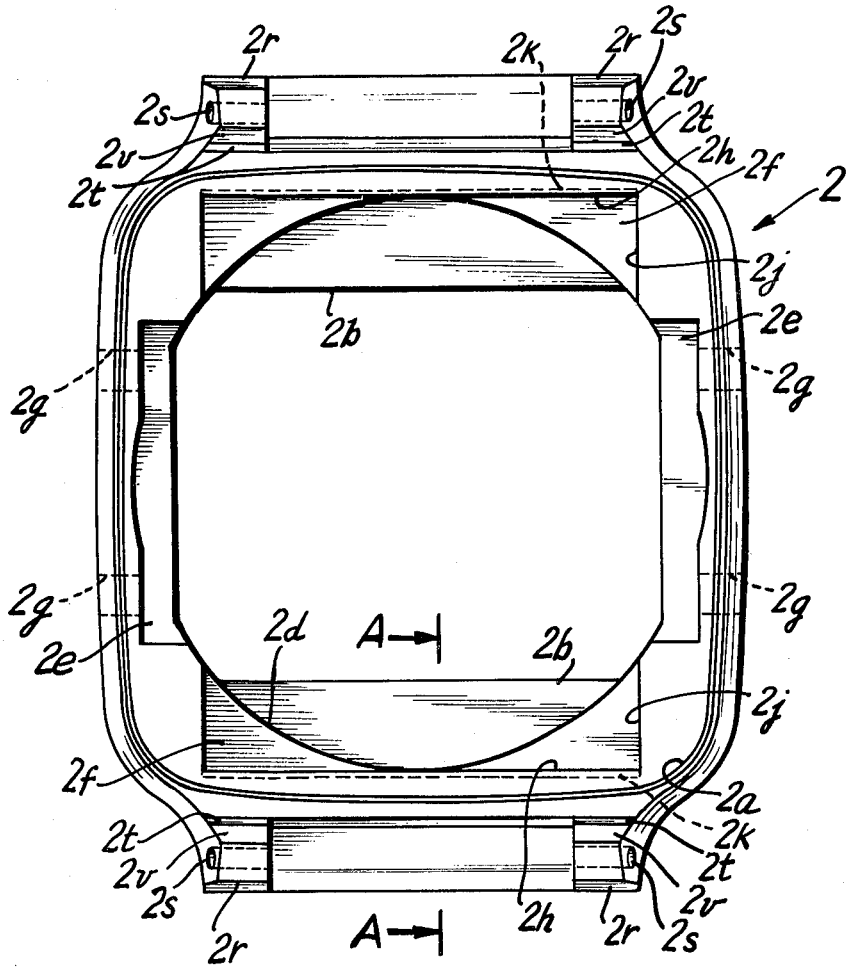
FIG. 1 is a plan view of the back of the watch case.
Figure 2:
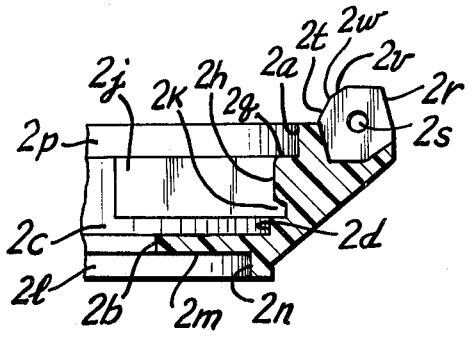
FIG. 2 is a partial cross-section along line A—A of FIG. 1.

FIGS. 1 and 2 show a watch case 2 which is typically made of injection molded plastic material; e.g., acrylonitrile butadiene styrene. The watch case includes a generally rectangular rear access opening defined by vertical wall 2*a* providing access to the watch interior and a smaller, generally rectangular front window defined by vertical wall 2*b* for viewing an electrooptical or other type time display (not shown) positioned in chamber 2*c* defined by circular vertical wall 2*d*. The chamber includes first and second lateral alcoves 2*e* into which switching components (not shown) for controlling display functions are positioned and first and second end alcoves 2*f* into which the molded legs 4*b* of the back cover member 4 extended when the back cover member is snap-fitted to the case. Side holes 2*g* communicate with lateral alcoves 2*e* and are adapted to receive pushbuttons (not shown) which are used to effect switching in well known manner. The end alcoves 2*f* are bounded by vertical walls 2*h* and 2*j* with vertical wall 2*h* being configured to provide an elongated slot 2*k* running the length of that wall for purposes to be described hereafter.

A recess 21 is provided in the front side of the watch case by intersecting walls 2*m* and 2*n*. A watch crystal (not shown) is positioned in the recess 21 in conventional fashion. A recess 2*p* is provided in the rear side of the watch case by intersecting walls 2*a* and 2*q* and is adapted to receive a portion of the back cover member as described hereinafter.

On the exterior of the watch case are molded lugs 2*r* each having a passage 2*s* therethrough to receive conventional pin bars (not shown) of a watch band or strap to be attached to the watch case. An important feature of each case lug is the provision of a first slanted wall 2*t* and a second slanted wall 2*v* having a different slant and intersecting at a preselected position to form a fulcrum 2*w*, shown most clearly in FIG. 2. For example, first slanted wall 2*t* inclines at an angle of 70° relative to horizontal while second slanted wall 2*v* inclines at an angle of only 40° relative to the horizontal.

Figure 3:
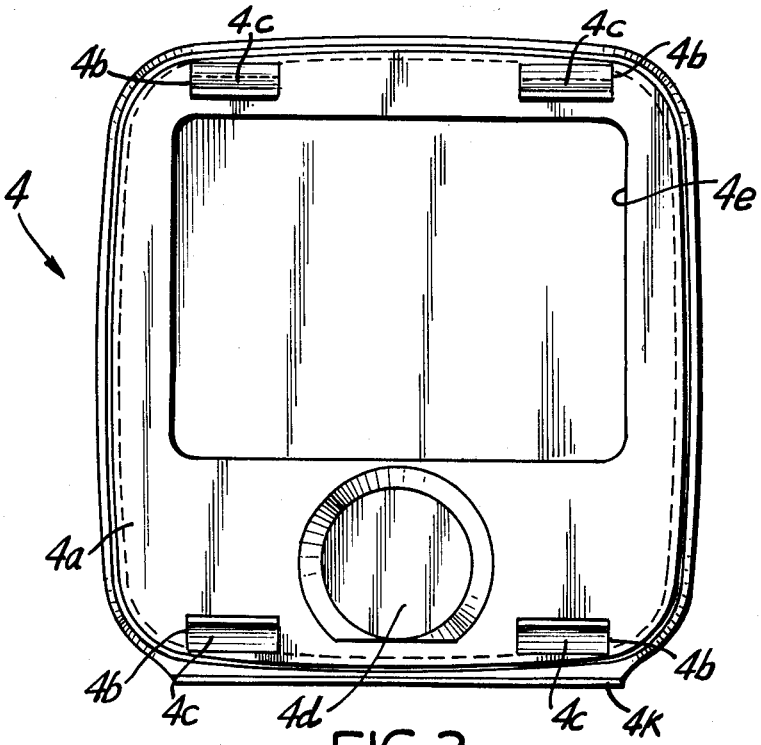
FIG. 3 is a plan view of the front of the back cover member.
Figure 4:
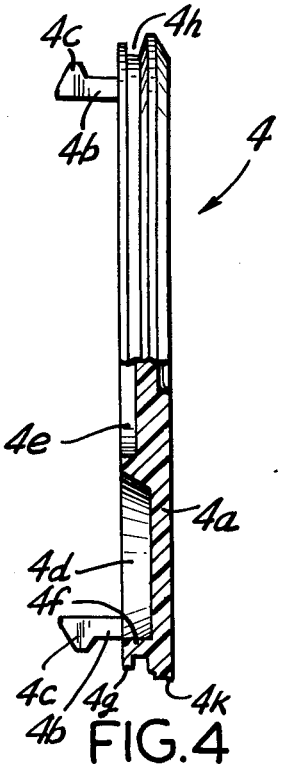
FIG. 4 is a partial side elevation and partial cross-section of the back cover member.
Figure 5:
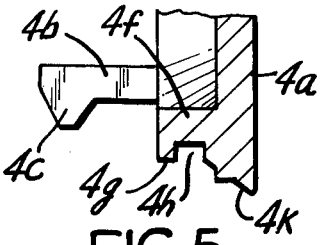
FIG. 5 is an enlarged partial cross-section of FIG. 4.
Figure 6:
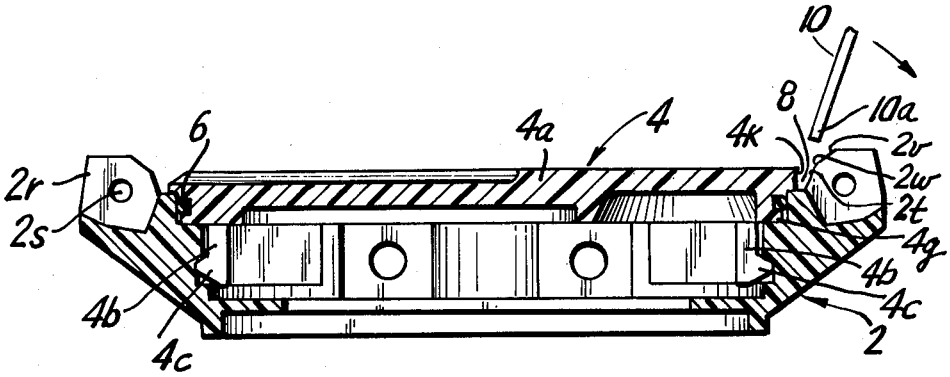
FIG. 6 is a cross-section of the watch case and caseback snap-fitted together.

FIGS. 3–5 illustrate the back cover member 4 in detail and FIG. 6 shows the back cover member 4 snap-fitted to case 2. The back cover member typically is injection molded of plastic material (acrylonitrile butadiene styrene) and includes a cover plate 4*a* having on its front side (facing the case) four molded legs 4*b* extending into the watch case 2. Each leg includes an outwardly projecting rib 4*c* adapted to snap-fit in the elongated slots 2*k* in end alcoves 2*f* of the watch case, see FIG. 6. Cover plate 4*a* also includes a circular recess 4*d* on its front side to receive portions of a conventional button cell (not shown) used to power the watch and a rectangular recess 4*e* to receive portions of the electronic components of the watch. A peripheral rib 4*f* also extends from the cover plate toward the case and includes an exterior upright wall 4*g* having a groove 4*h* therein to receive a resilient sealing gasket 6, FIG. 6. As shown, when the back cover member is snap-fitted to the case, the exterior wall 4*g* of the rib is disposed adjacent the vertical wall 2*a* of the case with the resilient sealing gasket 6 compressed therebetween to provide a water-tight seal.

An important feature of the back cover member 4 is the presence of slanted lip 4*k* along a side facing the first slanted wall 2*t* of the watch case lugs. Lip 4*k* is slanted at an angle to the horizontal similar to wall 2*t*; i.e., about 70°, so that the lip 4*k* and wall 2*t* define a pair of slots 8 between each lug and the lip to receive one end of a conventional credit card 10, as shown in FIG. 6.

Removal of the caseback is effected simply by inserting the end 10*a* of the credit card into slots 8 with intermediate portions of the card resting on fulcrums 2*w* and applying a force in the direction of the arrow (clockwise in the figure) to cause the credit card to function as a lever to unsnap the caseback. By using a conventional credit card which is usually made of plastic, damage to the plastic case 2 and caseback 4 is avoided. The force exerted on the lip 4*k* of the caseback is distributed along its entire length to avoid possible breakage or cracking of the lip. Of course, other removal tools resembling a credit card may also be used. However, since credit cards are so prevalent in modern society, they provide the most convenient means for removal of the caseback and the present invention is directed to taking advantage of this situation.

While there have been described what are considered to be preferred embodiments of the invention, other modifications will occur to those skilled in the art and it is desired to cover in the appended claims all such modifications as fall within the spirit and scope of the invention.

I claim:

1. A timepiece assembly comprising:

a. a plastic back cover member having a slanted lip along a straight side thereof and having attachment means projecting therefrom, and b. a plastic case having an access opening in one side thereof over which the back cover member is positioned to close off said opening, said case including means for engaging the attachment means of the back cover member in snap-fit relation and further including a pair of lugs adjacent the lip of the back cover member for receiving conventional pin bars with each lug having a first slanted wall spaced from said lip to define an open-ended slot between said lugs and the lip to receive one end of a credit card and, each lug further having a second slanted wall intersecting said first slanted wall to define at their intersection a fulcrum on each lug adapted to contact the credit card intermediate its ends, whereby said credit card can be used as a lever to unsnap the back cover member from the case.

2. The assembly of claim 1 which further includes a sealing gasket positioned between the back cover member and case.

3. The assembly of claim 1 wherein the projecting attachment means of the back cover member comprise a plurality of attachment legs.

4. In a timepiece assembly, wherein a plastic back cover member is snap-fitted to a plastic case to close off an access opening therein, said case including first and second pairs of spaced lugs on opposite sides of the case adapted to receive conventional pin bars, the improvement comprising:

a slanted lip defined along a straight line on at least one side of said back cover member adjacent said first pair of lugs, each lug on said first pair of lugs including a first slanted wall spaced from the lip of said back cover member to define an open-ended slot between said lugs and the lip to receive one end of a credit card or the like, each of said lugs also including a second slanted wall intersecting the first slanted wall to define at their intersection a fulcrum associated with each lug arranged to contact the credit card intermediate its ends, whereby said back cover member can be unsnapped from said case by using the credit card or the like as a lever.

* * * * *